US008469841B1

(12) United States Patent
Giauque et al.

(10) Patent No.: US 8,469,841 B1
(45) Date of Patent: Jun. 25, 2013

(54) HOCKEY PUCK REBOUNDER

(76) Inventors: Paul R. Giauque, Fargo, ND (US); Riley R. Giauque, Fargo, ND (US)

( * ) Notice: Subject to any disclaimer, the term of this patent is extended or adjusted under 35 U.S.C. 154(b) by 317 days.

(21) Appl. No.: 13/009,963

(22) Filed: Jan. 20, 2011

Related U.S. Application Data

(60) Provisional application No. 61/296,739, filed on Jan. 20, 2010, provisional application No. 61/307,132, filed on Feb. 23, 2010.

(51) Int. Cl.
*A63B 69/00* (2006.01)

(52) U.S. Cl.
USPC ..... 473/446; 473/164; 473/434

(58) Field of Classification Search
USPC ..... 273/395, 396; 473/434, 435, 443, 473/164, 446
See application file for complete search history.

(56) References Cited

U.S. PATENT DOCUMENTS 3,065,971 A * 11/1962 Coles ..... 473/182
3,171,657 A * 3/1965 Strang ..... 473/182
3,342,495 A * 9/1967 Wasley ..... 473/164
3,955,815 A * 5/1976 Deschesnes ..... 473/446
4,460,176 A * 7/1984 Peters ..... 273/127 C
4,886,274 A * 12/1989 Park ..... 473/164
5,351,960 A * 10/1994 Knapp ..... 473/182
5,362,045 A * 11/1994 Hammett et al. ..... 473/435
6,099,420 A * 8/2000 Nandra ..... 473/446
6,328,664 B1 * 12/2001 Hammett ..... 473/422
6,569,041 B1 * 5/2003 Riivald ..... 473/446
D628,253 S * 11/2010 McKinney et al. ..... D21/722
7,905,800 B2 * 3/2011 Oneschuk ..... 473/446
D637,669 S * 5/2011 McKinney et al. ..... D21/722
2002/0151386 A1 * 10/2002 Williams ..... 473/446
2005/0032580 A1 * 2/2005 Rango ..... 473/164
2005/0245332 A1 * 11/2005 Smith ..... 473/415
2006/0063615 A1 * 3/2006 Richardson et al. ..... 473/446

* cited by examiner

*Primary Examiner* — Mark Graham
(74) *Attorney, Agent, or Firm* — Neustel Law Offices

(57) ABSTRACT

A hockey puck rebounder having a frame, a first and second support each extending from opposing ends of the frame, a resilient rebound member comprised of an endless-looped band and extending between the first and second supports such that the resilient rebound member is secured in a taut manner to provide a resilient spring-back force when struck by a hockey puck or ball, and various securing structures for securing the frame in a stationary manner to a playing or shooting surface. The securing structures may include a counterweight, a lower plate for sandwiching a panel, such as a piece of synthetic ice between the lower plate and the frame, and/or fasteners extended through defined openings in the frame for securing the frame to a panel or a sheet of ice.

14 Claims, 12 Drawing Sheets

HOCKEY PUCK REBOUNDER

CROSS REFERENCE TO RELATED APPLICATIONS

I hereby claim benefit under Title 35, United States Code, Section 119(e) of U.S. provisional patent application Ser. No. 61/296,739 filed Jan. 20, 2010 and to provisional patent application Ser. No. 61/307,132 filed Feb. 23, 2010. The 61/296,739 application and the 61/307,132 application are currently pending. The 61/296,739 application and the 61/307,132 application are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a hockey training device and more specifically it relates to a hockey puck rebounder for rebounding a hockey puck or ball to a player when shot against.

2. Description of the Related Art

Any discussion of the related art throughout the specification should in no way be considered as an admission that such related art is widely known or forms part of common general knowledge in the field.

Hockey training techniques and devices have been in use for years. Typically, it is required to have multiple players working together to practice passing and one-timer shots; however for various reasons it may not always be possible for multiple players to practice together. Because of the inherent problems with the related art, there is a need for a new and improved hockey puck rebounder for rebounding a hockey puck or ball to a player when shot against.

BRIEF SUMMARY OF THE INVENTION

A system for rebounding a hockey puck or ball to a player when shot against. The invention generally relates to a hockey training device which includes a frame, a first and second support each extending from opposing ends of the frame, a resilient rebound member comprised of an endless-looped band and extending between the first and second supports such that the resilient rebound member is secured in a taut manner to provide a resilient spring-back force when struck by a hockey puck or ball, and various securing structures for securing the frame in a stationary manner to a playing or shooting surface. The securing structures may include a counterweight, a lower plate for sandwiching a panel, such as a piece of synthetic ice between the lower plate and the frame, and/or fasteners extended through defined openings in the frame for securing the frame to a panel or a sheet of ice.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
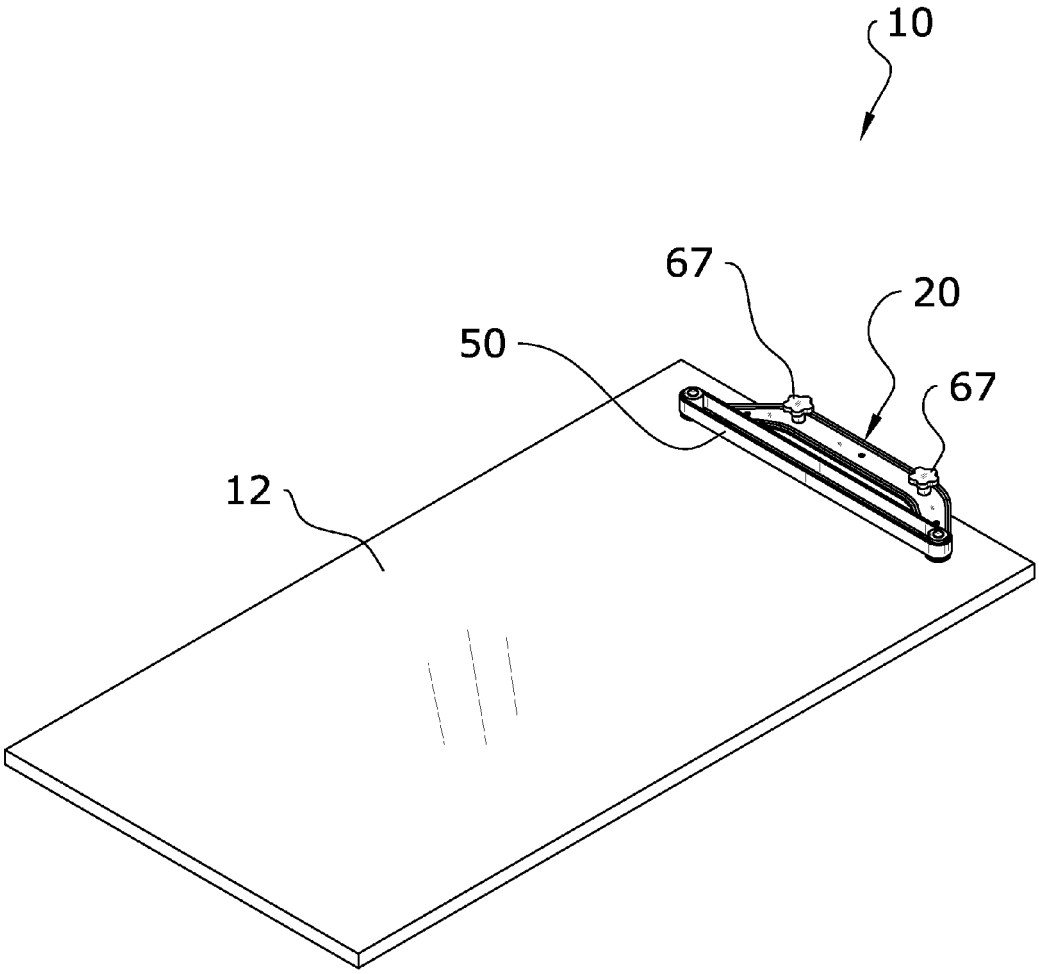
FIG. 1 is an upper perspective view of the present invention attached to a supporting object comprised of a synthetic ice panel.

Turning now descriptively to the drawings, in which similar reference characters denote similar elements throughout the several views, FIGS. 1 through 12 illustrate a hockey puck rebounder 10, which comprises a frame 20, a first and second support 40, 45 each extending from opposing ends 21, 22 of the frame 20, a resilient rebound member 50 comprised of an endless-looped band and extending between the first and second supports 40, 45 such that the resilient rebound member 50 is secured in a taut manner to provide a resilient spring-back force when struck by a hockey puck or ball, and various securing structures for securing the frame 20 in a stationary manner to a playing or shooting surface 12 of a supporting object or structure 14.

Figure 5:
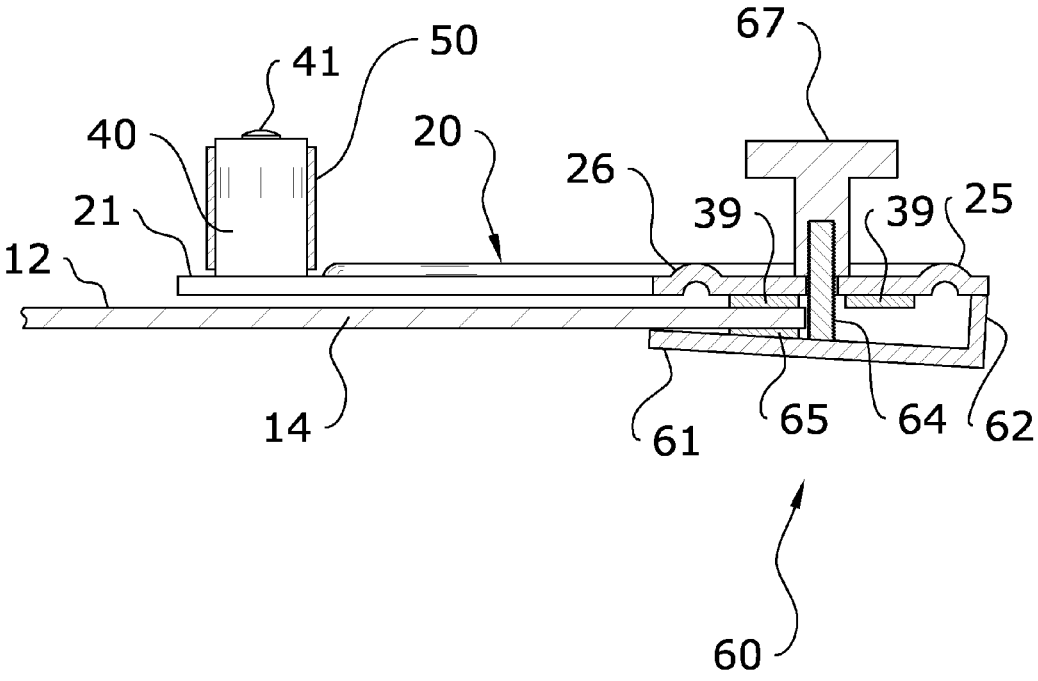
FIG. 5 is a sectional view taken along lines 5-5 of FIG. 2 and showing a supporting object attached between thereof.
Figure 6:
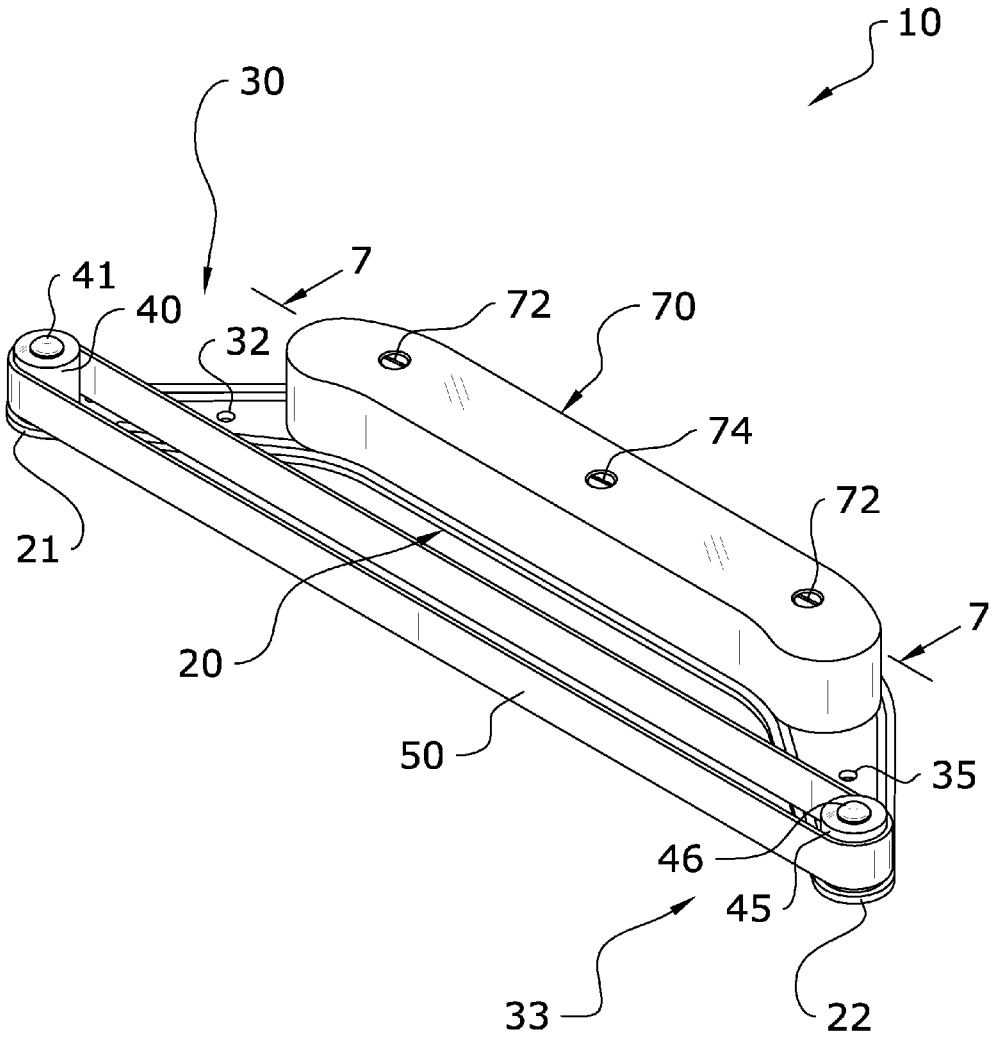
FIG. 6 is an upper perspective view of the present invention with the counterweight.
Figure 7:
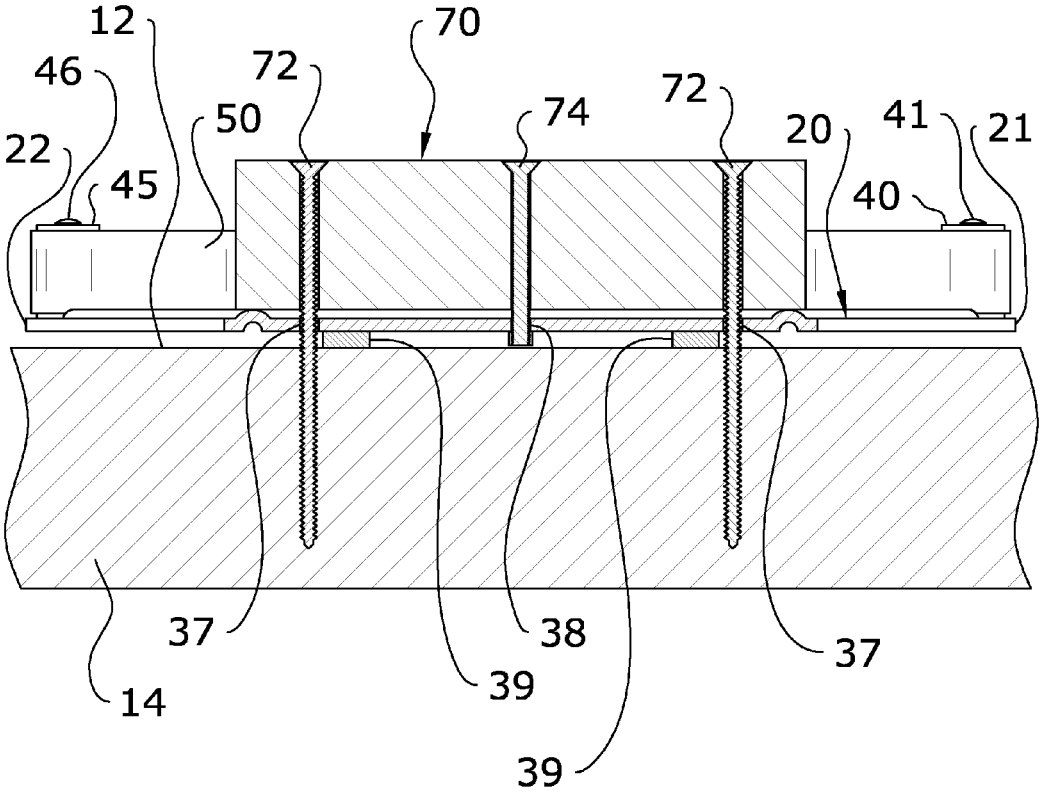
FIG. 7 is a sectional view taken along lines 7-7 of FIG. 6 and attached to a supporting object.
Figure 8:
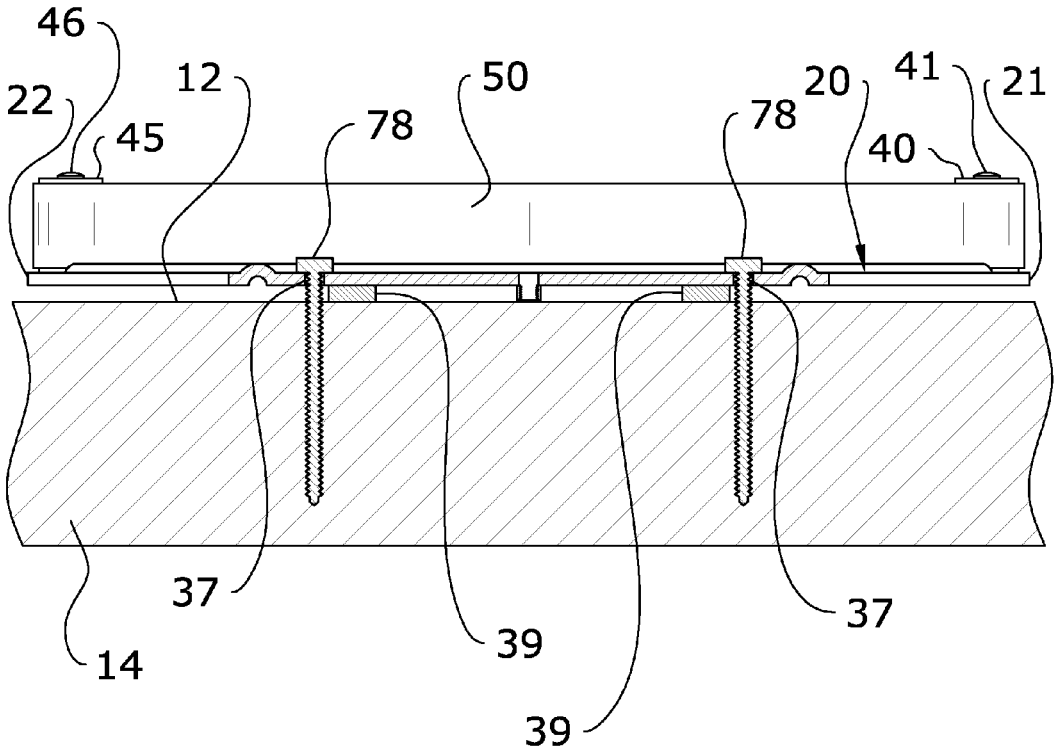
FIG. 8 is a sectional view of the present invention without the clamp assembly or the counterweight and attached to a supporting object.

The securing structures 14 may include a lower plate 61 for sandwiching a panel, such as a sheet of synthetic ice between the lower plate 61 and the frame 20, wherein the lower plate 61 is vertically adjustable relative the lower plate 61 and has resistance members to hold the panel taut such as illustrated in FIG. 5. The securing structures may also include fasteners 78 extended through defined openings 37 in the frame 20 for securing the frame 20 to a panel or a sheet of real or synthetic ice such as illustrated in FIG. 8. The training device 10 may be mounted on the side, end, corner, or other location upon the supporting structure (E.g. synthetic ice). A counterweight 70 may also be used in addition to direct attachment of the frame 20 to the supporting structure 14 such as illustrated in FIG. 7.

B. Frame

The frame 20 is generally held stationary and used to support the rebound member 50 while the rebound member 50 is being shot against. The frame 20 may be secured to a stationary object, such as a fixed panel including a floor board, a real or synthetic ice sheet, such as in a hockey arena, or the frame 20 may be secure to a movable objects, such as a movable panel including a board, synthetic ice, or various other structures, all which preferably include a surface on which the hockey puck or ball may glide or roll upon from a point of being shot to the rebounder and back toward a shooter or receiver of the pass. Alternately, weight may be applied upon the frame 20 to hold the frame 20 in a stationary position when attachment to the supporting structure is not desired.

The frame 20 is generally comprised of a rigid and strong structure able to withstand forces from the incoming hockey puck or ball. The frame 20 may be comprised of separate pieces attached together; however the frame 20 is preferably comprised of an integral one-piece structure, such as a formed piece of metal (e.g. 12 gauge) or a molded plastic piece.

The frame 20 generally includes a rear support 25 perpendicularly extending upwardly along the rear peripheral edge of the frame 20 and comprised of a ridge or 90 degree bend for increasing the strength of the frame 20 and substantially restricting the end portions 30, 33 from moving inwardly due to the tension of the rebound members 50 or the force of the incoming hockey puck or ball. The frame 20 also preferably includes a front support 26 comprised of a ridge spaced slightly inwardly from and following the front peripheral edge of the frame 20 for providing additional strength to the frame 20.

The supports are generally integral with the frame 20 and may be comprised of a ridge, 90-degree flange 62 or various other structures. The front and rear supports 25 are generally recessed or tapered to a point near flush with the upper surface of the frame 20 near the bushings to permit room for the support bushings 40, 45 and rebound member 50.

Figure 2:
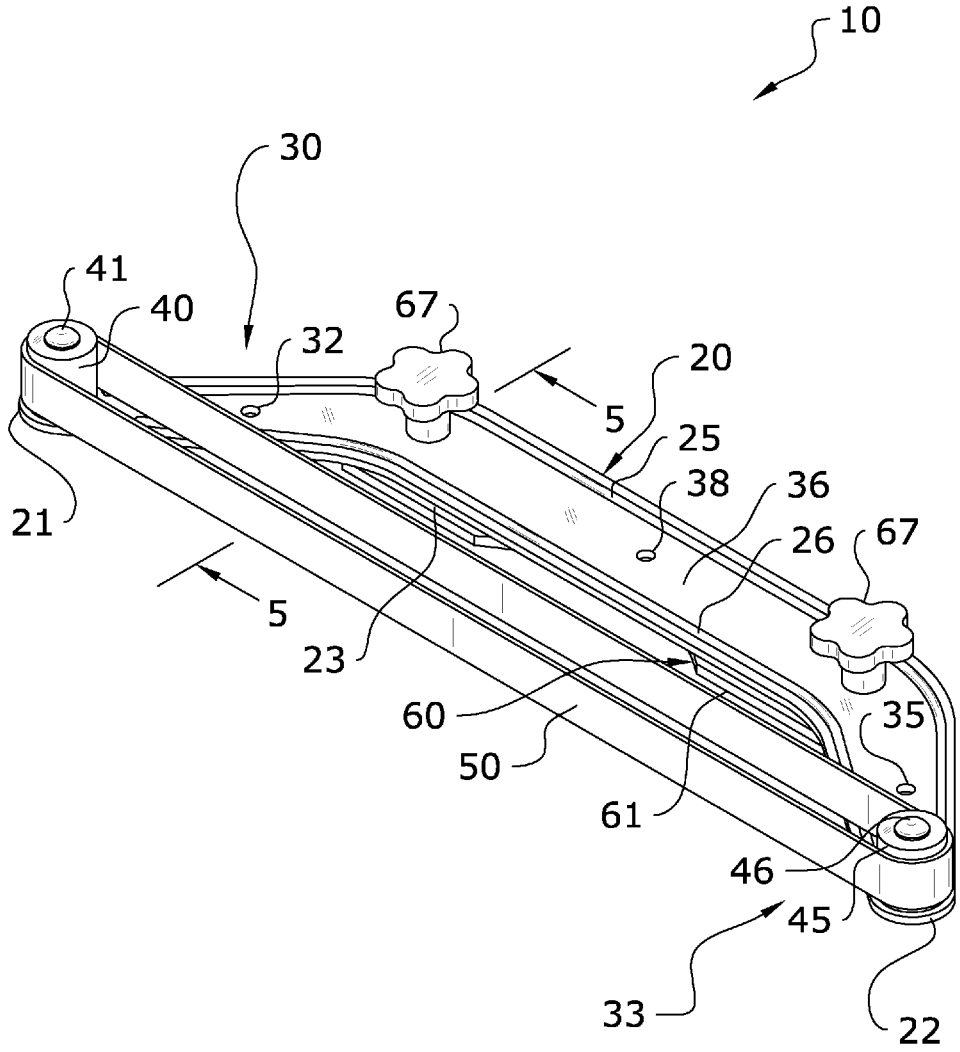
FIG. 2 is an upper perspective view of the present invention with the clamp assembly.
Figure 3:
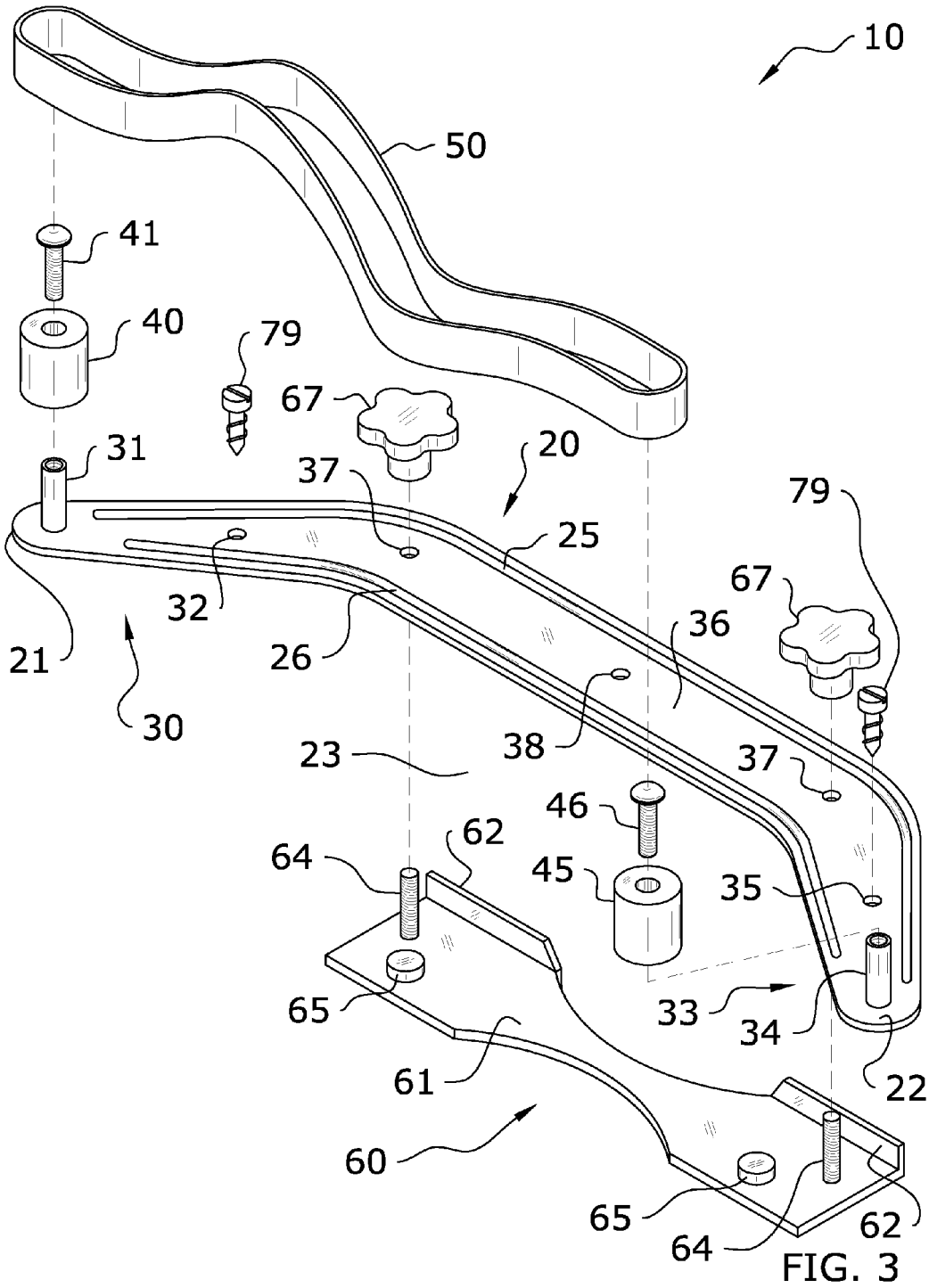
FIG. 3 is an exploded upper perspective view of the present invention with the clamp assembly.
Figure 4:
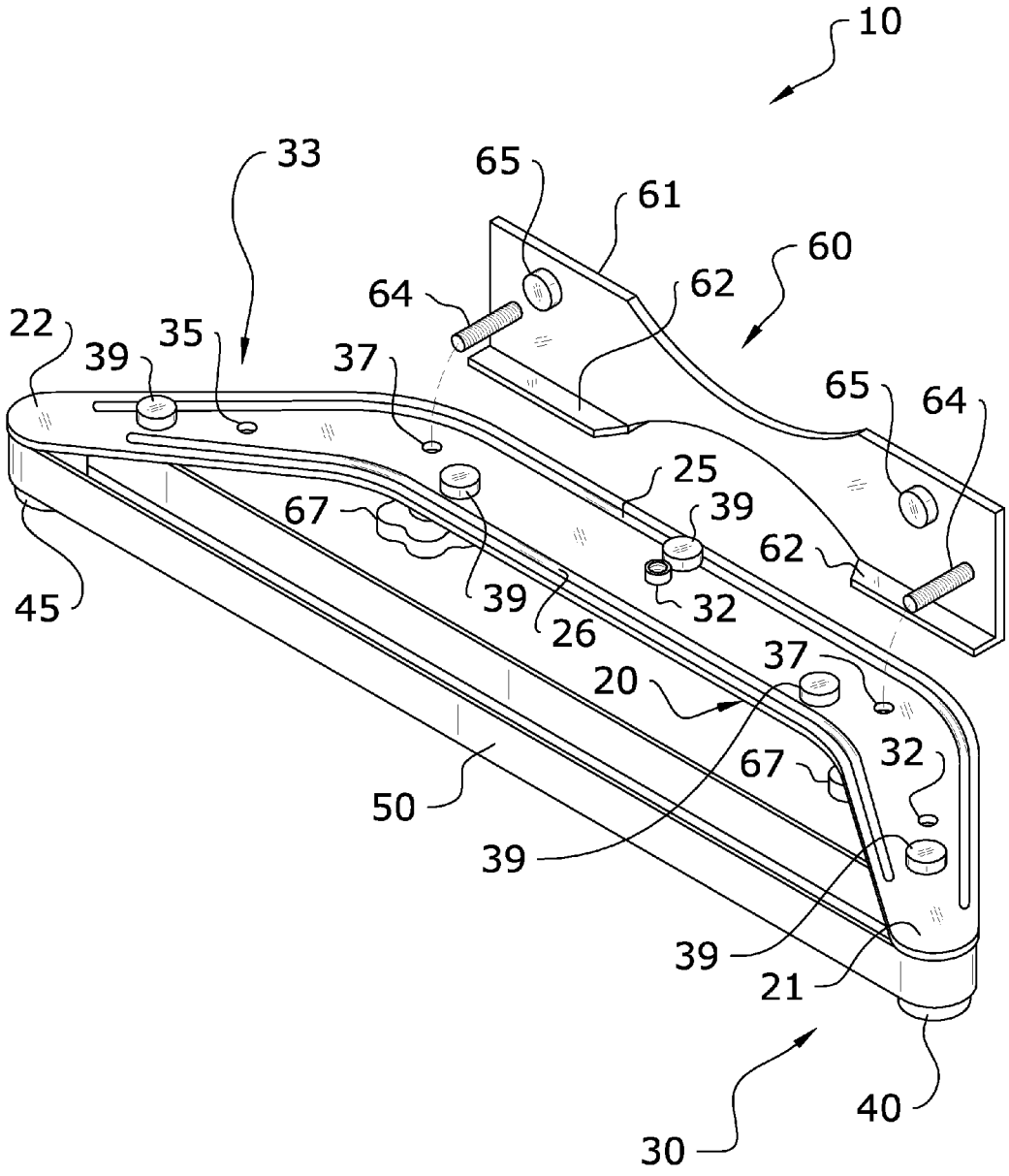
FIG. 4 is an upper perspective view of the present invention with the clamp assembly and with the lower plate exploded and illustrating the bottom of the frame.

The frame 20 generally takes the form of a U-shape, V-shape, or other shape with a first end 21, second end 22, and gap 23 formed between thereof to leave room for operation of the rebound member 50 and to allow for the frame 20 to be mounted at various locations upon the ice, such as the end, side, or corner of the ice sheet. More particularly, the frame 20 includes a first end portion 30 leading to a first end 21 of the frame 20, a second end portion 33 leading to a second end portion 33 of the frame 20, and a center portion 36 between the first end portion 30 and the second end portion 33, wherein the first end portion 30 and the second end portion 33 extend linearly from opposing ends of the center portion 36 to form the U-shaped or V-shaped structure. The first end portion 30 is also generally orthogonal to the second end portion 33 thus allowing for the frame 20 to attach in a flush manner along corners of synthetic ice or shooting boards. The first end portion 30 may include one or more openings 32, the second end portion 33 may include one or more openings 35, and the center portion 36 may include one or more openings 37, 38 as illustrated in FIG. 2.

Figure 9:
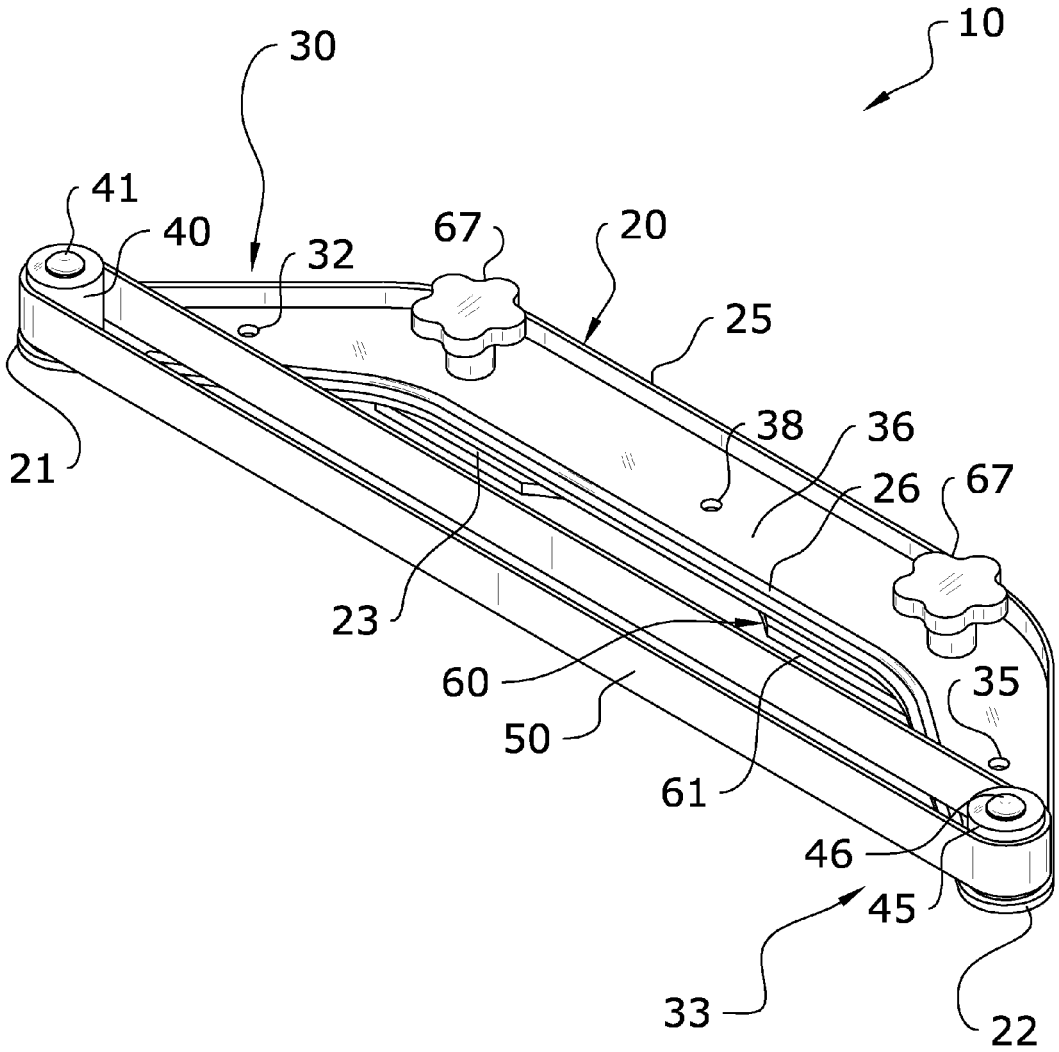
FIG. 9 is an upper perspective view of the present invention with the support bushing extending upwardly and the rear support comprised of a 90-degree bend.
Figure 10:
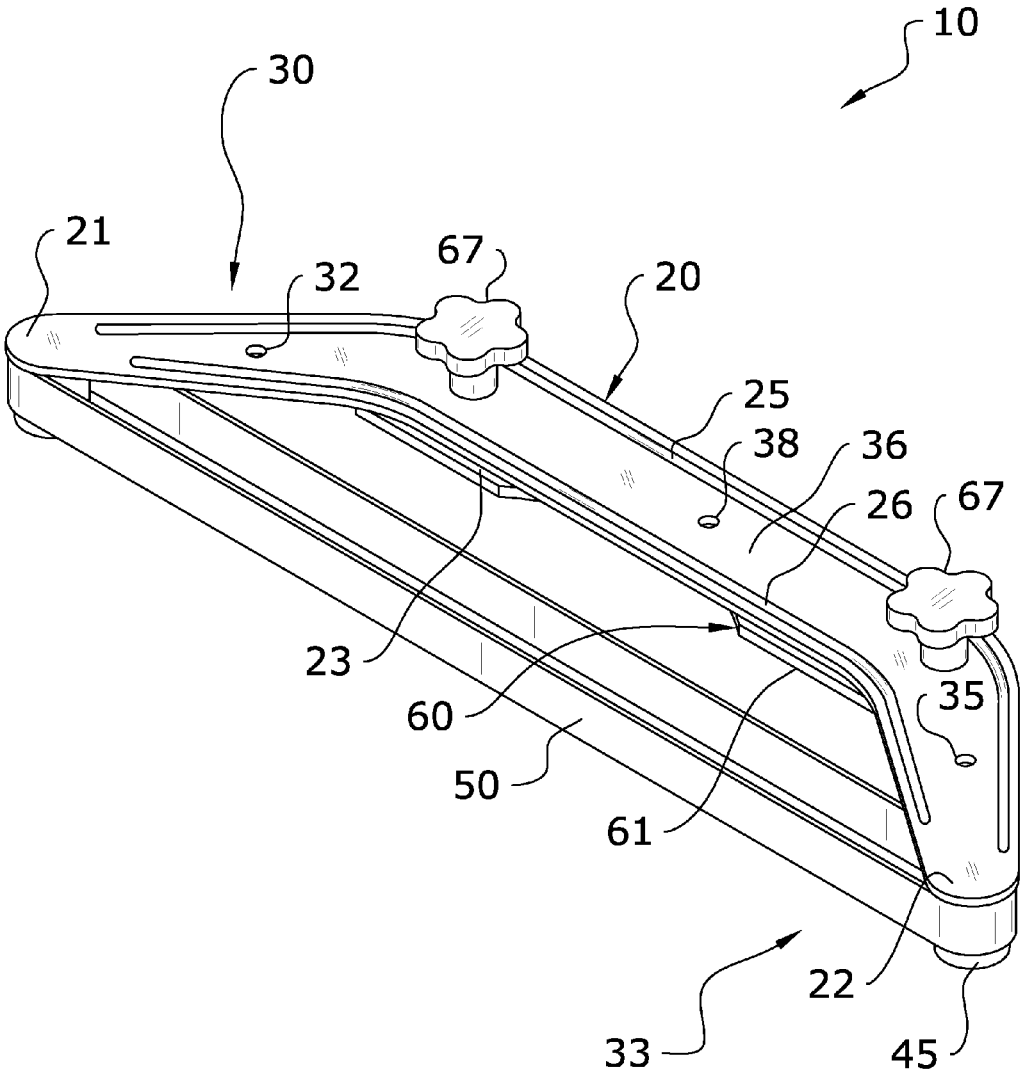
FIG. 10 is an upper perspective view of the present invention with the support bushing extending downwardly.

The first end portion 30 also generally includes a first retaining post 31 secured thereto at the first end 21 of the frame 20 and extending in an orthogonal upward or downward direction and the second end portion 33 also generally includes a second retaining post 34 secured thereto at the second end 22 of the frame 20 and extending in an orthogonal upward or downward direction. The first retaining post 31 and the second retaining post 34 may directly receive the rebound member 50; however the first retaining post 31 and the second retaining post 34 preferably receive a first support 40 and a second support 45 which receive the rebound member 50 as illustrated in FIGS. 9 and 10. The first retaining post 31 and the second retaining post 34 are preferably captive studs being threadably formed along an interior and fixed to the frame 20, such as in a threaded, integral, press-in, or other manner.

The frame 20 also generally includes a plurality of grip pads 39 positioned along a lower surface of the frame 20 for engaging the panel and/or ice sheet thus both increasing frictional contact to the panel and/or ice sheet to prohibit movement of the frame 20 as illustrated in FIGS. 5, 7, and 8 and also for restricting freezing of the frame 20 to the ice sheet as illustrated in FIGS. 7 and 8. The grip pads 39 are preferably comprised of a sandpaper structure (E.g. 36 grit-type). The grip pads 39 may be secured to the lower surface of the frame 20 in various manners.

C. Supports

The present invention generally includes a first support 40 retained upon the first retaining post 31 and a second support 45 retained upon the second retaining post 34. The first support 40 and the second support 45 are generally each hollow to receive the retaining post 31, 34, wherein a first fastener 41 and a second fastener 46 are then used to secure the first support 40 and the second support 45 upon the first retaining post 31 and the second retaining post 34 respectively as illustrated in FIG. 2.

The first support 40 and the second support 45 are generally comprised of identical structures and are preferably comprised of a hollow, cylindrical high-density and impact-resistant plastic-bushing structure that can be tightened to increase strength. The first support 40 and the second support 45 may be comprised of various sizes, such as but not limited to having a 1 inch diameter. The first support 40 and the second support 45 are able to rotate about their respective retaining post and are able to be tightened so there is a minimal amount of friction, thus providing equal tension across the face of the resilient rebound member 50.

Figure 11:
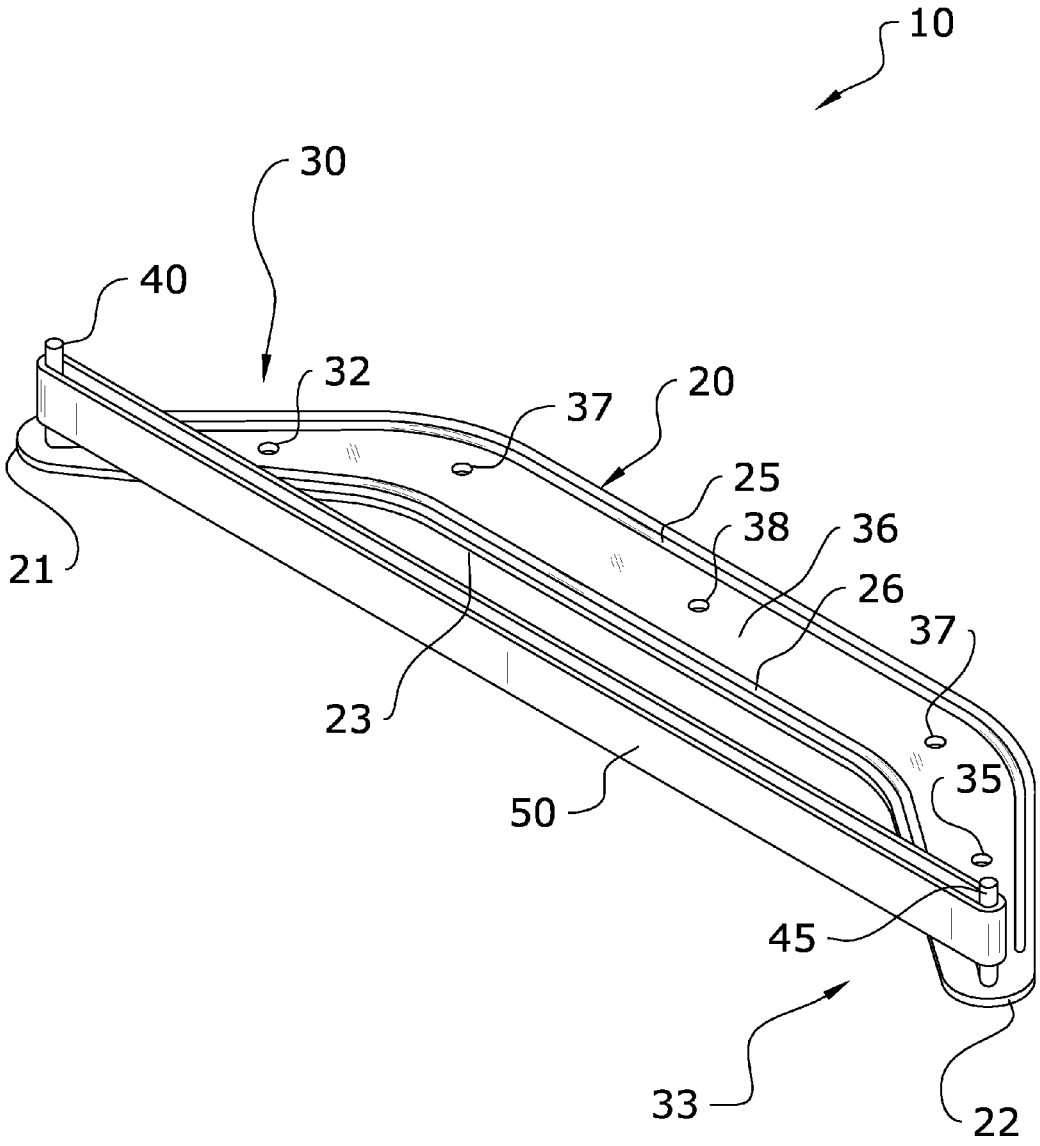
FIG. 11 is an upper perspective view of the present invention with the support integral with the frame.

The first support 40 and the second support 45 preferably extend upwardly in an orthogonal manner from the frame 20 as illustrated in FIG. 9; however it is appreciated that the first support 40 and the second support 45 may extend downwardly in an orthogonal manner from the frame 20 as illustrated in FIG. 10. The supports 40, 45 may also be integral with the frame 20 as illustrated in FIG. 11. Either way that the first support 40 and the second support 45 extend, the first support 40 and the second support 45 retain the lower end of the rebound member 50 slightly above the shooting surface to allow for forward and reverse movement of the rebound member 50 and the first support 40 and the second support 45 retain the upper end of the rebound member 50 at a point preferably substantially similar or slightly above the uppermost point of the hockey puck or ball.

D. Rebound Member

The rebound member 50 is comprised of a resilient material and is adapted to be secured in a taut manner around the first support 40 and the second support 45 to provide a resilient spring-back force when struck by the hockey puck or ball. The hockey puck or ball is preferably shot at the center of the rebound member 50 to provide optimal return force.

The rebound member 50 is preferably comprised of an endless-loop band structure. The rebound member 50 is further preferably comprised of a rubber or silicone base material. In alternate embodiments, the rebound members 50 may be stretch cord or any stretching material. Although various sizes may be appreciated, the rebound member 50 preferably has a height of approximately 1 inch, a width between 9 and 14 inches depending upon the desired tension, and a thickness between $1/16^{th}$ and $1/8^{th}$ inch depending upon the desired tension.

Figure 12:
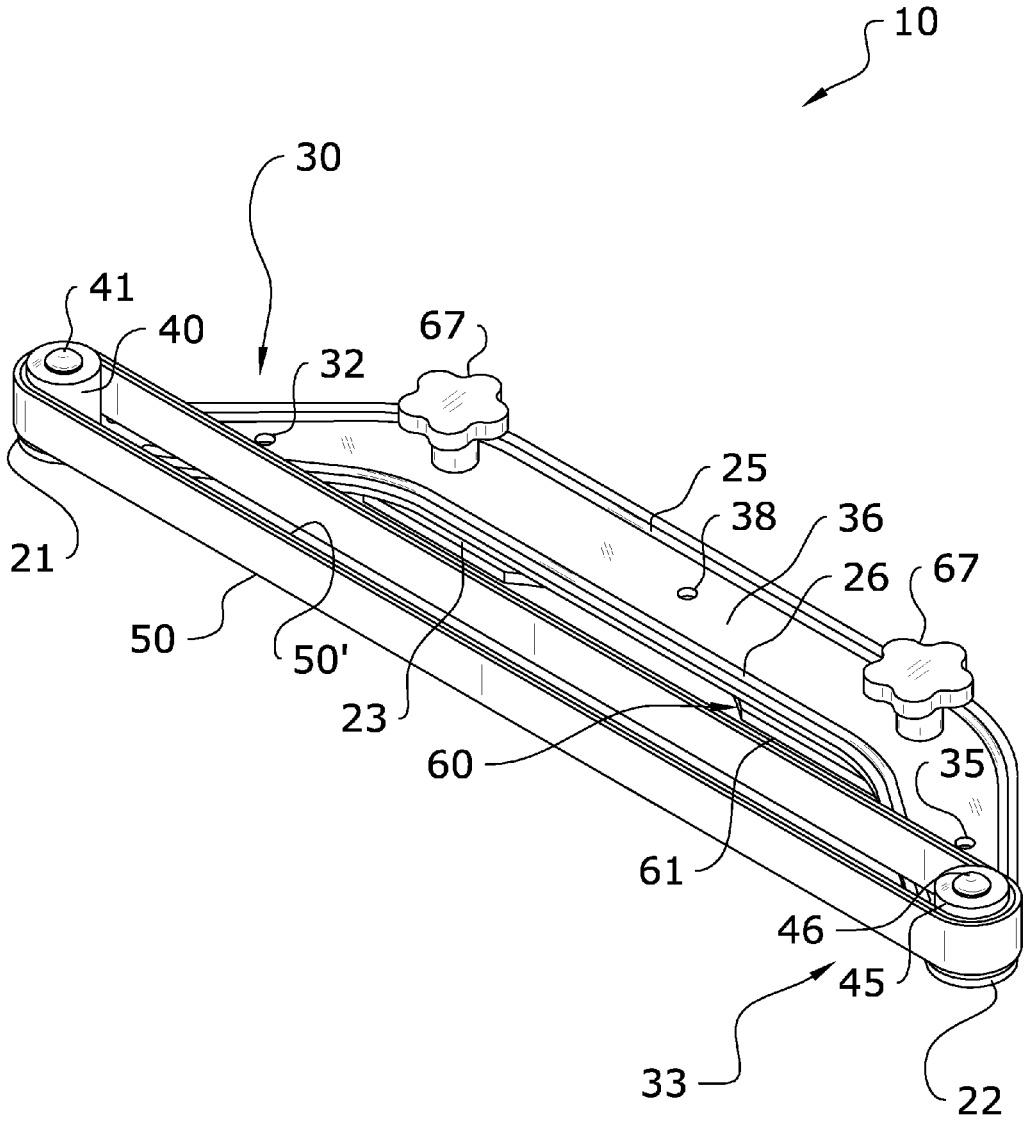
FIG. 12 is an upper perspective view of the present invention with multiple rebounding members used.

It is appreciated that multiple rebound members 50, 50' may be used such as illustrated in FIG. 12, wherein a second rebound member 50' encircles a first rebound member 50, to increase the tautness and spring-back force for returning the hockey puck or ball to the player at a greater speed.

E. Securing Structures

The frame 20 is generally secured or held stationary to a supporting object 14 via a securing structure to keep the frame 20 in a stationary position while the hockey puck or ball engages the rebound member 50. The securing structure may take the form of various embodiments depending upon the supporting object 14 used to secure the frame 20.

In one embodiment, the securing structure is comprised of a clamping assembly 60 and includes a lower plate 61 with rear flanges 62, retaining posts 64, grip pads 65, and adjustment knobs 67. The lower plate 61 is generally comprised of a flat-plate like structure comprised of a metal material (E.g. 12 gauge, 14 gauge) or alternately plastic, and has an hourglass shape with rear flanges 62 extending upwardly from opposing end portions of the lower plate 61 for engagement with the lower surface of the rear support 25 of the peripheral edge of the frame 20 or the lower surface of the rear peripheral edge of the frame 20 (if the rear support 25 is spaced inwardly) and to allow the lower plate 61 to create a pinching action along the front side of the frame 20 and lower plate 61 when tightened as illustrated in FIG. 5.

The lower plate 61 also includes one or more retaining posts 64 having external threads and extending upwardly from the lower plate 61 adjacent the end portions of the lower plate 61 and through the openings 37 of the center portion 36 to be threadably received by the adjustment knobs 67 for vertical adjustment of the lower plate 61 with respect to the frame 20. The retaining posts 64 are preferably comprised of captive studs being threadably formed along an exterior and fixed to the lower plate 61, such as in a threaded, integral, press-in, or other manner.

The lower plate 61 may also include grip pads 65 comprised of a sandpaper structure (E.g. 36 grit-type) and fastened to the upper surface of the lower plate 61 for engagement with the supporting object 14 that is clamped between the lower plate 61 and the frame 20 to help retain the frame 20 in place with respect to the supporting object 14.

Alternately, one or more fasteners 78, such as screws, etc., may be extended through the openings 37 and then into the supporting object 14 for attachment thereto, such as when attaching the frame 20 directly to the ice sheet or to a structure that is not desired to be clamped between the frame 20 and the lower plate 61. In addition, reinforcement fasteners 79, such as screws may be extended through the openings 32, 35 in addition to the fasteners 78, the counterweight 70, or the clamp assembly 60.

The counterweight 70 may be attached to the upper surface of the center portion 36 of the frame 20 via extending fasteners 72, 74 through the openings 37, 38 of the center portion 36 to provide weight to the frame 20 to counter the force incurred by the rebound member 50 from the hockey puck or ball and thus restrict vibration of the frame 20 and a quicker and smoother return of the hockey puck or ball from the rebound member 50, as well as hold the frame 20 stationary.

The fasteners 72 securing the counterweight 70 to the frame 20 are preferably countersunk within the counterweight 70 and are further preferably long enough to extend into the supporting object 14, such as the ice sheet to firmly secure the frame 20 in place. The counterweight 70 may include a separate fastener 74 for securement of the counterweight 70 to the frame 20 via the center opening 38 of the center portion 36. It is appreciated that in alternate embodiments the counterweight 70 may be used to simply hold the frame 20 stationary upon the supporting object 14 without direct attachment to the supporting object 14. The counterweight 70 is generally used in place of the clamping assembly 60 or fasteners 78, 79; however it is appreciated that the counterweight 70 may be used in addition to other methods of securement.

F. Operation and Installment of Preferred Embodiment

In use, the training device 10 is designed to mount on synthetic or real ice quickly and easily. The training device will service a hockey puck or ball back to the user or another player which will improve stick handling, passing, rebounding, obtaining "soft hands", and also one-timer shots.

For installment of the training device 10 to synthetic ice or shooting boards as illustrated in FIG. 1, the adjustment knobs 67 are first loosened thus increasing the distance between the lower plate 61 and the frame 20 so as to be greater than the thickness of the synthetic ice or shooting board. The synthetic ice or shooting board is then slid into the space between the frame 20 and the lower plate 61 until the synthetic ice or shooting boards engages the retaining posts 64 of the lower plate 61. The adjustment knobs 67 are then tightened equally, thus causing grip pads 39, 65 located on the frame 20 and the lower plate 61 to engage the synthetic ice or shooting board and help retain the frame 20 stationary to the synthetic ice or shooting board as illustrated in FIG. 5.

For aggressive passing, fasteners 79, such as screws, are installed through the openings 32, 35 of the end portions 30, 33 of the frame 20 and are extended into the supporting object 14 (E.g. synthetic ice or shooting boards) to help retain the frame 20 in place. The vertical placement of the rebound member 50 is also preferably adjusted so that the top of the rebound member 50 is the same height as the hockey puck or ball. The vertical placement of the rebound member 50 is adjusted by circulating the rebound member 50 from side-to-side around the first and second supports 40, 45.

For installment of the training device 10 to real ice or boards/panels not having an accessible edge or corner such as illustrated in FIG. 8, the clamp assembly 60 is removed from the lower plate 61 and the lower surface of the frame 20 is placed upon the desired location of the supporting structure. Fasteners 78, such as screws, are extended through the openings 37 of the center portion 36 and optionally through the openings 32, 35 of the end portions 30, 33 using a drill, screw driver, or other tool to match the head of the fasteners. The counterweight 70 is attached in a similar manner as shown in FIG. 7.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A hockey training device for rebounding a playing object, comprising:

a frame having a first end and a second end;

a first support connected to said first end;

a second support connected to said second end;

one or more resilient rebound members extending between said first support and said second support such that said one or more resilient rebound members are secured in a taut manner to provide a resilient spring-back force when struck by a playing object; and a means for securing said frame to a shooting surface in a stationary manner;

wherein said means for securing said frame includes a clamping assembly, wherein said clamping assembly includes:

a lower plate having a front edge, a rear edge, at least one rear flange, and at least one retaining post;

wherein said at least one rear flange extends upwardly from said rear edge of said lower plate to engage a rear edge of said frame;

wherein said at least one retaining post extends upwardly from said lower plate and through at least one opening of said frame;

wherein a supporting object having said shooting surface thereon is adapted to be extended between said lower plate and said frame so that a peripheral edge of said supporting object engages said at least one retaining post; and at least one adjustment knob threaded to said at least one retaining post, wherein said at least one adjustment knob is adapted to provide for vertical adjustment of said lower plate relative said frame such as to secure said supporting object between said lower plate and said frame;

wherein engagement of said rear flange with said frame causes said front edge of said lower plate to vertically adjust closer to a lower surface of said frame than said rear edge of said lower plate such as to angle said lower plate upwardly from said rear edge of said lower plate to said front edge of said lower plate.

2. The hockey training device of claim 1, wherein said frame comprises a U-shaped or V-shaped structure.

3. The hockey training device of claim 2, wherein said frame includes a first end portion leading to said first end, a second end portion leading to said second end, and a central portion, wherein said first end portion and said second end portion extend angularly outward from opposing ends of said central portion to form a gap between said first end and said second end, wherein said resilient rebound member extends across said gap.

4. The hockey training device of claim 3, wherein said first end portion is orthogonal with respect to said second end portion.

5. The hockey training device of claim 1, wherein said frame is comprised of an integral one-piece structure.

6. The hockey training device of claim 1, wherein said first support and said second support are each comprised of bushing structures.

7. The hockey training device of claim 1, wherein said first support and said second support each extend upwardly from said frame, such as to extend away from said shooting surface.

8. The hockey training device of claim 1, wherein said first support and said second support each extend downwardly from said frame, such as to extend toward said shooting surface.

9. The hockey training device of claim 1, wherein said first support and said second support are each integral with said frame.

10. The hockey training device of claim 1, wherein said one or more resilient rebound members are each comprised of an endless-looped band structure.

11. The hockey training device of claim 10, wherein said one or more resilient rebound members are comprised of a plurality of resilient rebound members.

12. The hockey training device of claim 1, including one or more grip pads attached to a lower surface of said frame and/or an upper surface of said lower plate for contacting said supporting object.

13. A hockey training device for rebounding a playing object, comprising:

a frame having a first end, a first end portion leading to said first end, a second end, a second end portion leading to said second end, and a central portion;

wherein said first end portion and said second end portion extend angularly outward from opposing ends of said central portion to form a gap between said first end and said second end and wherein said first end portion is orthogonal with respect to said second end portion;

a first support bushing connected to said first end;

a second support bushing connected to said second end;

one or more resilient rebound members extending between said first support and said second support across said gap such that said one or more resilient rebound members are secured in a taut manner to provide a resilient spring-back force when struck by a playing object;

wherein said one or more resilient rebound members are each comprised of an endless-looped band structure; and a means for securing said frame to a shooting surface in a stationary manner;

wherein said means for securing said frame includes a clamping assembly, wherein said clamping assembly includes:

a lower plate having a front edge, a rear edge, at least one rear flange, at least one retaining post, and one or more grip pads;

wherein said at least one rear flange extends upwardly from said rear edge of said lower plate to engage a rear edge of said frame;

wherein said at least one retaining post extends upwardly from said lower plate and through at least one opening of said frame;

wherein a supporting object having said shooting surface thereon is adapted to be extended between said lower plate and said frame so that a peripheral edge of said supporting object engages said at least one retaining post; and at least one adjustment knob threaded to said at least one retaining post, wherein said at least one adjustment knob is adapted to provide for vertical adjustment of said lower plate relative said frame such as to secure said supporting object between said lower plate and said frame;

wherein engagement of said rear flange with said frame causes said front edge of said lower plate to vertically adjust closer to a lower surface of said frame than said rear edge of said lower plate such as to angle said lower plate upwardly from said rear edge of said lower plate to said front edge of said lower plate;

wherein said one or more grip pads are located adjacent said front edge of said lower plate and for contacting said supporting object.

14. A hockey training system for rebounding a playing object, comprising:

a supporting object comprised of a panel structure;

a frame having a first end, a first end portion leading to said first end, a second end, a second end portion leading to said second end, and a central portion, and one or more first grip pads;

wherein said first end portion and said second end portion extend angularly outward from opposing ends of said central portion to form a gap between said first end and said second end;

wherein said first end portion is orthogonal with respect to said second end portion;

a first support bushing connected to said first end;

a second support bushing connected to said second end;

one or more resilient rebound members extending between said first support and said second support across said gap such that said one or more resilient rebound members are secured in a taut manner to provide a resilient spring-back force when struck by a playing object;

wherein said one or more resilient rebound members are each comprised of an endless-looped band structure; and a clamping assembly for securing said frame to said supporting object, wherein said clamping assembly includes a lower plate having a front edge, a rear edge, at least one rear flange, at least one retaining post, at least one adjustment knob, and one or more second grip pads;

wherein said at least one rear flange extends upwardly from said rear edge of said lower plate to engage a rear edge of said frame;

wherein said at least one retaining post extends upwardly from said lower plate and through at least one opening of said frame;

wherein said supporting object is adapted to be extended between said lower plate and said frame so that a peripheral edge of said supporting object engages said at least one retaining post; and wherein said at least one adjustment knob threaded to said at least one retaining post, wherein said at least one adjustment knob is adapted to provide for vertical adjustment of said lower plate relative said frame such as to secure said supporting object between said lower plate and said frame;

wherein engagement of said rear flange with said frame causes said front edge of said lower plate to vertically adjust closer to a lower surface of said frame than said rear edge of said lower plate such as to angle said lower plate upwardly from said rear edge of said lower plate to said front edge of said lower plate;

wherein said one or more first grip pads of said frame and said one or more second grip pads of said lower plate and for contacting said supporting object.

* * * * *